United States Patent [19]

Ogata et al.

[11] 4,389,112

[45] Jun. 21, 1983

[54] TRANSFER SHEET SEPARATING/CONVEYING APPARATUS FOR USE IN ELECTROPHOTOGRAPHIC COPYING MACHINES

[75] Inventors: Yoshihiro Ogata; Yoshihiro Abe, both of Tokyo, Japan

[73] Assignee: Ricoh Company, Ltd., Japan

[21] Appl. No.: 213,687

[22] Filed: Dec. 5, 1980

[30] Foreign Application Priority Data

| | | | |
|---|---|---|---|
| Dec. 10, 1979 | [JP] | Japan | 54-160074 |
| Dec. 29, 1979 | [JP] | Japan | 54-173782 |
| Jan. 19, 1980 | [JP] | Japan | 5-5000 |
| Jan. 19, 1980 | [JP] | Japan | 55-5001 |

[51] Int. Cl.[3] ..... G03G 15/16; G03G 15/22

[52] U.S. Cl. ..... 355/3 TR; 271/310; 271/311; 271/DIG. 2; 355/3 SH

[58] Field of Search ..... 355/3 R, 3 TR, 3 SH, 355/3 TE, 14 SH, 14 TR; 271/307, 308, 310, 311, 312, DIG. 2

[56] References Cited

U.S. PATENT DOCUMENTS

| | | | |
|---|---|---|---|
| 3,893,761 | 7/1975 | Buchan et al. | 355/3 R |
| 3,926,429 | 12/1975 | Satomi et al. | 271/DIG. 2 |
| 3,976,370 | 8/1976 | Goel et al. | 355/3 R |

*Primary Examiner*—Fred L. Braun

*Attorney, Agent, or Firm*—Guy W. Shoup; Gerard F. Dunne; Eliot S. Gerber

[57] ABSTRACT

A transfer sheet separating/conveying member is formed of an electrically conductive material, and has its part disposed close to or in contact with the peripheral surface of a photosensitive drum for movement in the same direction as the drum. The separating/conveying member is applied with a voltage of the same polarity as that of a voltage applied to the transfer sheet. An insulating material covers at least a portion of the laterally opposite sides of the separating/conveying member which are located opposite to the drum surface. A corner of the separating/conveying member which is not covered by the insulating material and remains exposed is shaped into a rounded form.

21 Claims, 11 Drawing Figures

FIG. 1
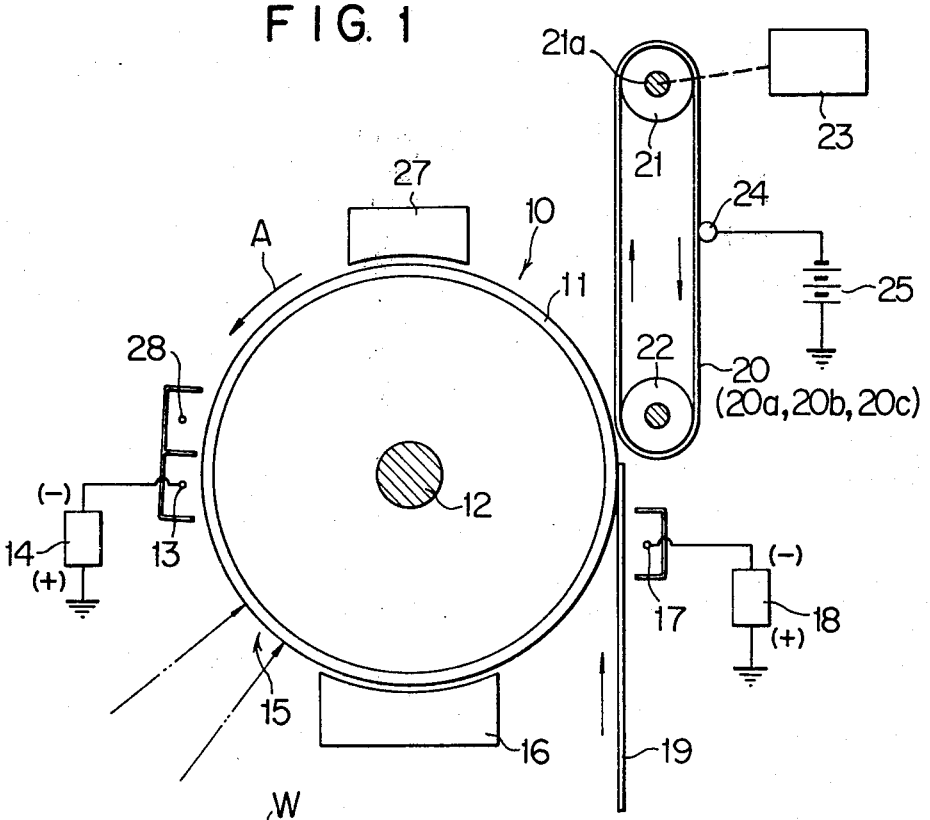
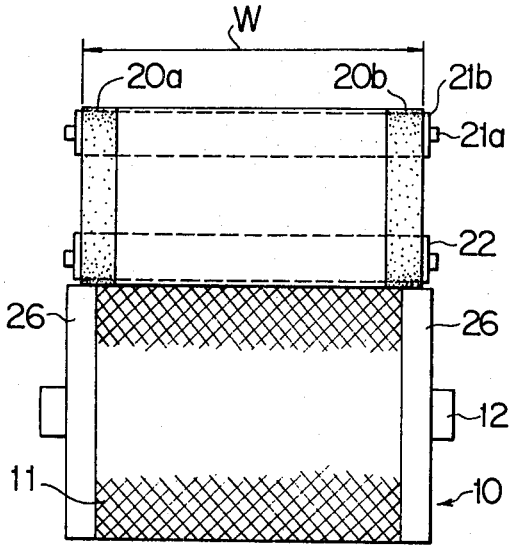
FIG. 2

TRANSFER SHEET SEPARATING/CONVEYING APPARATUS FOR USE IN ELECTROPHOTOGRAPHIC COPYING MACHINES

BACKGROUND OF THE INVENTION

The invention relates to an apparatus for depositing a toner on an electrostatic latent image formed on a photosensitive surface, for transferring the toner image onto a transfer sheet under application of a transfer field, and for subsequently separating the transfer sheet from the photosensitive surface and conveying it.

The present inventors have previously proposed a technique in which a toner image formed on a photosensitive member is transferred onto a transfer sheet by the application of an electric field to the transfer sheet, which is then brought close to a grounded conductor belt to cause an electrostatic induction to induce an electric charge in the belt of the opposite polarity from that of the transfer sheet so that the force of attraction acting between the transfer sheet and the photosensitive member is less in magnitude than the force of attraction acting between the transfer sheet and the conductor belt, thereby allowing the transfer sheet to be separated from the photosensitive surface and held attracted to the conductor belt for conveying purpose.

In the technique described, there has been experienced a problem that the number of lines of electric force acting between the transfer sheet and the toner transferred onto the latter decreases with time by an amount corresponding to an increase in the sheet of lines of electric force extending between the transfer sheet and the conductor belt, whereby the binding force which constrains the toner particles to the transfer member diminishes to cause a reverse transfer of the toner particles to the photosensitive surface having an increased force of attraction, giving rise to the likelihood that a failure of transfer is likely to occur in an image region having an increased amount of toner deposition.

SUMMARY OF THE INVENTION

It is an object of the invention to provide an image transferring, separating and conveying apparatus for use in an electrophotographic copying machine which is capable of eliminating the difficulty of causing a failure of transfer which occurs as a toner image, which is once transferred onto a transfer sheet, is reversely transferred to a photosensitive member as the transfer sheet is separated from the photosensitive surface.

It is another object of the invention to provide an image transferring, separating and conveying apparatus for use in an electrophotographic copying machine which is capable of eliminating the occurrence of a spark discharge across a transfer sheet separating/conveying member and a photosensitive surface.

The above objects are achieved in accordance with the invention by providing a transfer sheet separating/conveying member which is formed of an electrically conductive material. A voltage of the same polarity as that of the charge of the transfer sheet is applied to the separating/conveying member, whereby a failure of transfer is avoided.

In accordance with another aspect of the invention, a portion of the separating/conveying member which is located opposite to a photosensitive surface is covered with an insulating material. In the event of a corner of the separating/conveying member remains uncovered by the insulating material, such corner is shaped into a rounded form, thereby avoiding the occurrence of spark discharge.

BRIEF DESCRIPTION OF THE DRAWINGS

FIG. 1 is a schematic illustration of a photosensitive drum illustrating an embodiment of the invention.

FIGS. 2 and 3 are side elevations illustrating the relationship between a photosensitive drum and an endless belt.

DESCRIPTION OF EMBODIMENTS

Figure 3:
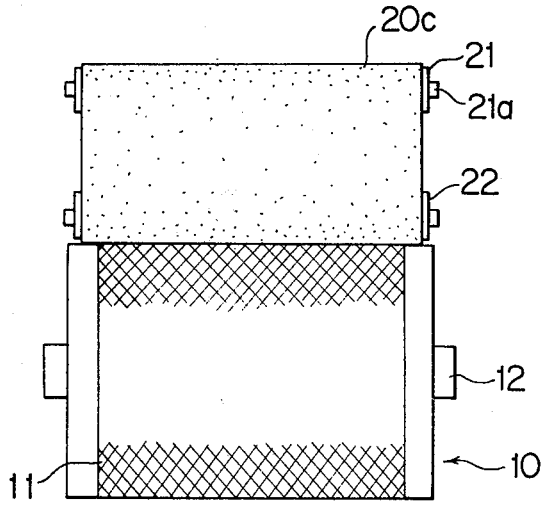

Referring to FIG. 1, there is shown a photosensitive drum 10 having a photosensitive surface 11 which is formed by a photoconductive material. The drum 10 is mounted on a shaft 12 for rotation in a direction indicated by an arrow A during a copying operation. A number of stations are disposed around the drum surface to enable a copying operation. These include a charger, an exposure station, a developing station, a transfer station, a separation station, a cleaning unit and a neutralizer, disposed around the latter in the sequence named, as viewed in the direction of rotation of the drum 10. A charger 13 is connected to the negative terminal of a power supply 14, and effects a corona discharge of a negative polarity in darkness against the drum surface before the exposure takes place.

An exposure station 15 is adapted to focus a light image of an original, not shown, onto the drum surface as the drum 10 rotates, thereby producing an electrostatic latent image thereon by the negative charge. A developing station 16 may utilize a developing unit of either wet type employing a liquid developer or a dry type employing a powder developer. In either instance, the developing station deposits a toner of positive charge on the latent image formed by the negative charge on the drum surface, thus converting it into a visual image.

A transfer station 17 includes a charger which is connected to the negative terminal of another power supply 18. A transfer sheet is fed to the transfer station in timed relationship with the movement of the toner image on the drum 10 to such station, and the charger 17 effects a corona discharge of the negative polarity against the back surface of the transfer sheet 19. As a result of such corona discharge, the transfer sheet 19 is charged to the negative polarity, so that the positive charge of the toner of the drum 10 is attracted by the negative charge on the transfer sheet to be transferred thereon. It is to be noted that at this time the transfer sheet 19 is brought into close contact with the photosensitive surface 11 with the toner image interposed therebetween.

A separation station includes an electrically conductive endless belt 20, acting as a transfer sheet separating-/conveying member, which extends around a pair of pulleys 21, 22 disposed in spaced and opposing relationship with each other. The lower end, as viewed in FIG. 1, of the belt is disposed close to or in contact with the drum surface 11. In the example shown, the belt comprises a sheet-shaped nickel belt having a thickness of 40 μm, but it should be understood that other materials such as stainless steel or carbon resin may also be used. The pulley 21 is mounted on a shaft 21*a* which is connected to a motor 23, serving as drive means, through a power transmission, not shown. In response to the drive from the motor 23, the belt 20 moves in a direction indicated by arrows. The outer surface of the belt 20 is contacted by a brush 24 which is connected to a further power supply 25 which supplies a voltage having value on the order of 600 V. The brush is connected to the negative terminal of the supply, and thus a voltage of the same polarity as that applied to the transfer sheet is applied to the brush.

FIG. 2 shows an example of the belt 20. Specifically, in this instance, the belt 20 comprises a pair of belt sections 20*a*, 20*b* which are spaced apart crosswise of the drum 10 or in the axial direction of the shaft 12. The distance between the outer extremities of the pair of belt sections 20*a*, 20*b* is substantially equal to or slightly less than the width of the drum 10.

FIG. 3 shows another example of the belt 20. In this instance, it comprises a single belt 20*c* having a width which is substantially equal to or slightly less than the width of the drum 10. It will be appreciated that the term "endless belt 20" referred to herein generically includes either the endless belt sections 20*a*, 20*b* of FIG. 2 or the belt 20*c* of FIG. 3.

In any event, in order to permit the belt 20 to be fully effective in separating a transfer sheet, the major portion thereof should be disposed in opposing relationship with the photosensitive surface 11. When disposed in this manner, the laterally outer ends may be located opposite to metallic portions of the drum 10. While the photosensitive surface 11 is applied to the substantial central region of the peripheral surface of the drum 10, such photosensitive surface is not applied to both lateral ends of the drum for manufacturing reasons or for purpose of preventing a contamination thereof by a developing solution, thus allowing metallic portions 26 to be exposed.

A toner image of the positive polarity which is transferred onto the transfer sheet 19 charged by a corona discharge from the charger 17 of the negative polarity is then attracted to the endless belt 20 under the electric influence as the transfer sheet 19 is brought into contact with the endless belt 20. When it is separated from the photosensitive drum 10, it is maintained in firm retention on the transfer sheet 19 without experiencing a reverse transfer onto the drum 10 because a voltage of the negative polarity which is the same polarity as the transfer member 19 (and of the opposite polarity to that of the toner image) is applied to the endless belt 20. It is believed that the positively charged toner image is attracted to the transfer sheet 19 and the endless belt under an attraction of a magnitude which is greater than that produced by the charge of the latent image on the drum 10. In this manner, as the toner image is separated from the drum 10, a reverse transfer thereof back onto the drum to cause the exposure of a white background in the copied image is positively avoided.

The transfer sheet 19 carrying the toner image and being conveyed by the endless belt 20 as attracted thereto is fed into a fixing unit, not shown, where a given fixing operation is performed to provide a finished copy which is delivered onto a tray.

On the other hand, a cleaning unit 27 is disposed downstream of the separation station as viewed in the direction of rotation of the drum 10, and any residual toner is removed from the drum surface as the drum surface passes under the cleaning unit 27. Subsequently, any residual charge is neutralized as the drum surface passes below a neutralizing charger 28, whereby the drum surface is prepared for a next copying cycle.

In the copying process described above, there exists a potential difference between the endless belt 20 and the drum 10 which may cause a breakdown of the surrounding air. In particular, it may cause a spark discharge to be produced between both of the lateral portions of the endless belt 20 and the metallic portions 26. Such spark discharge will tend to disturb the uniform force of attraction acting upon the toner which moves toward the transfer sheet 19, thereby causing a degradation in the transferred image.

To prevent such occurrence, the spark discharge is prevented in carrying out the invention by covering the outer ends of the endless belt with electrical insulating layer. Alternatively, where a covering with an electrical insulating layer cannot be implemented, the exposed outer ends and edges may be worked into a rounded form.

Figure 4:
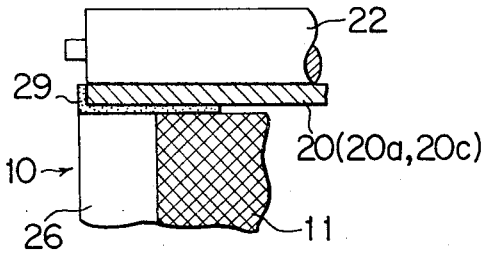
FIGS. 4 and 5 are fragmentary cross sections illustrating different conditions of a lateral end of the endless belt.
Figure 5:
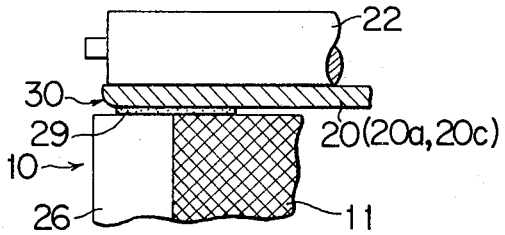

Referring to FIG. 2, the photosensitive material or surface 11 is applied to the drum 10 except the metallic portions 26 located at the lateral ends thereof in order to prevent a contamination by a developing solution during a developing step. The spark discharge occurred in the prior art between the exposed conductive metallic portions 26 and the endless belt 20. To accommodate for this problem, in accordance with the invention, an insulating material (as indicated at 29) covers at least region of the lateral sides of the endless belt 20 which are located opposite to the metallic portions 26, as shown in FIG. 3. The insulation is applied to a region of the endless belt 20 which entirely covers sub-regions opposing the metallic portions 26 of the drum 10 and which extends to a point opposing part of the photosensitive surface 11. As shown in exaggerated form in FIG. 4, the insulating material 29 also fully covers the lateral edges of the endless belt 20, thus preventing an exposure of any conductive material. Where difficulties are experienced in insulating the lateral edge of the endless belt 20, such lateral edge may be left exposed, but any corner in the exposed lateral edge of the belt 20 is shaved into a rounded form, as indicated at 30 in FIG. 5.

The insulation can be achieved by utilizing an insulating material having a dielectric strength and a relatively small capacitance, such as films of polyethylene terephthalate, polycarbonate or other resins, which is applied by spraying or dipping process. As a result of the described insulation, the occurrence of any spark discharge between the drum 10 and the endless belt 20 is eliminated, favorably permitting a sheet separation and an auxiliary transfer without degrading the image quality.

Figure 6:
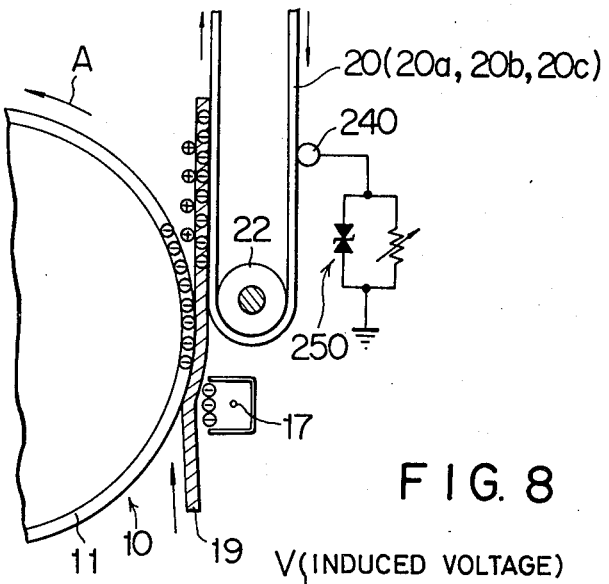
FIG. 6 is a fragmentary view of a transfer station illustrating another embodiment of the invention.
Figure 8:
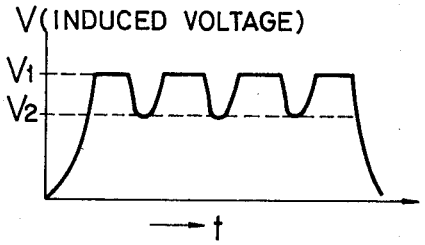
FIG. 8 graphically shows a voltage which is developed on the separating/conveying member shown in FIG. 6.
Figure 7:
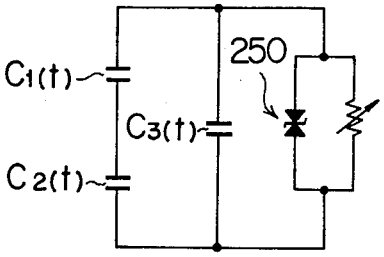
FIG. 7 is a circuit diagram of an electrical equivalent circuit which relates to the image transfer and separation illustrated in FIG. 6.

Another embodiment of the invention will be described with reference to FIG. 6 where similar parts as those shown in FIGS. 1 to 5 are designated by corresponding numerals unless confusion is likely. In FIG. 6, an endless belt 20 has its peripheral surface contacted by a brush 240 which is in turn connected to the ground through a constant voltage element 250. Considering the copying process subsequent to the transfer step, a toner image of the positive polarity which is formed on the drum 10 is transferred onto a transfer member 19 upon application of a transfer field of the negative polarity thereto from a transfer charger 17. Representing a capacitance formed between the transfer sheet 19 and the endless belt 20 as the sheet 19 approaches the latter in a direction indicated by an arrow, by $C_1(t)$, a capacitance formed between the transfer sheet 19 and the drum 10 by $C_2(t)$, a capacitance formed between the endless belt 20 and the drum 10 by $C_3(t)$ and a potential difference between the endless belt 20 and the drum 10 by V(t), an electrical circuit defined by these components can be expressed by an equivalent circuit shown in FIG. 7. The potential difference V is initially zero (0) as shown in FIG. 8 when the leading end of the initial transfer sheet 19 contacts the endless belt 20, but gradually increases in the negative direction as the area of contact between the transfer sheet 19 and the belt 20 increases. Ultimately it is maintained at a given negative voltage $V_1$ by the element 250. When the separation is completed, it assumes a lower negative voltage $V_2$. When a second and a subsequent transfer sheet is brought into contact with the endless belt 20, the induced voltage assumes the given value $V_2$ of the negative polarity, and alternates between this value and another given value $V_1$ of the negative polarity. Although the endless belt 20 assumes a negative potential, and thus the same polarity as the transfer sheet 19 and hence is desirably zero or close to zero for facilitating the separation, such value of the potential of the endless belt 20 will decrease the force of attraction acting upon the toner of the positive polarity, thus giving rise to likelihood that a toner of the positive polarity which has once been transferred onto the transfer sheet 19 may be reversely transferred back onto the drum 10 at the moment of separation. However, it should be understood that such phenomenon occurs only for the leading end of the transfer sheet 19 which is being separated from the drum 10. After the leading end of the transfer sheet 19 is separated, the given, negative voltage $V_1$ is applied to the endless belt 20 as indicated in FIG. 8, so that no failure of transfer occurs in an image region which is spaced a greater distance from the leading end of the transfer sheet 19 than a given value on the order of 7–8 mm. Even if certain non-uniformity is present in the degree to which each individual transfer sheet is charged, the peak voltage induced on the endless belt 20 is maintained at the given negative value $V_1$ by means of the constant voltage element 250, whereby the transfer performance is constant and stable. While this degrades the separation for a second and a subsequent transfer sheet, a smooth separation can be assured by shifting downwardly the endless belt 20 from its position shown in FIG. 6 to provide a layout which facilitates the separation of the transfer sheet 19 from the drum 10.

In accordance with the invention, the transfer sheet separating/conveying member or the endless belt 20 is connected to the ground through the constant voltage element 250, thereby positively preventing a failure of transfer of the toner image during the separation step though with a less stability for the separation of a second and a subsequent transfer sheet. In particular, a uniform transfer performance is assured independently from any non-uniformity in the degree to which individual copy members are charged.

In this embodiment, there exists a potential difference between the endless belt 20 and the drum 10, giving rise to the occurrence of spark discharge. Hence, the endless belt 20 may be worked in the manner illustrated in FIGS. 4 and 5.

Figure 9:
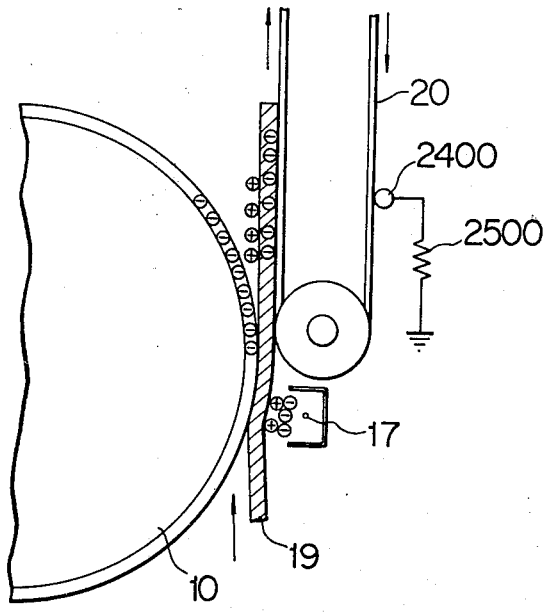
FIG. 9 is a fragmentary view of a transfer station, illustrating a further embodiment of the invention.
Figure 10:
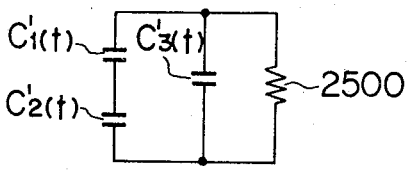
FIG. 10 is a circuit diagram of an electrical equivalent circuit representing the image transfer and separation illustrated in FIG. 9.
Figure 11:
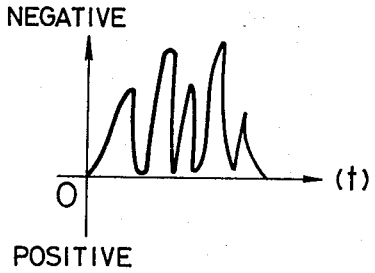
FIG. 11 graphically shows a voltage developed on the separating/conveying member of FIG. 9.

FIG. 9 shows a further embodiment of the invention where the peripheral surface of an endless belt 20 is contacted by a brush 2400 which is in turn connected to the ground through a resistor 2500. Considering the copying process subsequent to the transfer step, the application of a negative transfer field to a transfer sheet 19 by means of a transfer charger 17 causes a toner image of the positive polarity which is formed on the drum 10 to be transferred onto the transfer sheet 19. An equivalent circuit of associated parts is shown in FIG. 10 where $C_1'(t)$ represents a capacitance formed between the transfer sheet 19 and the endless belt 20 as the transfer sheet 19 approaches the endless belt 20 in a direction indicated by an arrow $C_2'(t)$ a capacitance formed between the transfer sheet 19 and the drum 10, $C_3'(t)$ a capacitance formed between the endless belt 20 and the drum 10 and $V'(t)$ a potential difference developed between the endless belt 20 and the drum 10. As indicated in FIG. 11, the potential difference $V'(t)$ of the endless belt 20 is zero at the time when the leading end of the transfer sheet 19 contacts the endless belt 20, and increases in the negative direction in a gradual manner as the area of contact between the transfer sheet 19 and the endless belt 20 increases. As shown in FIG. 11, the potential alternates between peaks and valleys for succssive transfer sheets. The voltage induced on the endless belt 20 is a potential of the same polarity as that of the transfer sheet 19, and hence, the separation will be improved if the potential remains zero or close to zero. On the other hand, this decreases the force of attraction acting upon the toner of the positive polarity, giving rise to likelihood that a reverse transfer back onto the drum 10 of the positive toner which has once been transferred onto the transfer sheet 19 may occur. However, such phenomenon occurs only at the leading end of the transfer sheet 19 as it is being separated from the drum 10. After the leading end of the transfer sheet 19 is separated, a negative potential of an increased magnitude is induced on the belt 20 as indicated in FIG. 11, so that a failure of transfer does not occur in an image area which is spaced a greater distance from the leading end of the transfer sheet 19 than a given value on the order of 7–8 mm. It will be noted that the magnitude of the peak voltage varies depending on the non-uniformity in the degree to which the individual copy sheets are charged to cause an instability in the separation performance, but a smooth separation can be assured by providing a suitable layout such as shifting the belt 20 to a location more downward than the position shown in FIG. 9 inasmuch as the leading end of the transfer sheet 19 is separated.

In accordance with the invention, the connection of the transfer sheet separating/conveying member or the endless belt 20 to the ground through the resistor positively prevents a failure of transfer of the toner image during the separation step even though the stability of the separation performance may be somewhat reduced.

In this embodiment again, there exists a potential difference between the endless belt 20 and the drum 10 which might give rise to the occurrence of a spark discharge. Accordingly, it is very effective to work the endless belt 20 in the manner mentioned in connection with FIGS. 4 and 5.

What is claimed is:

1. An apparatus for separating and conveying a transfer sheet for use in an electrophotographic copying machine in which a toner is deposited on an electrostatic latent image formed on the surface of a photosensitive drum to provide a toner image which is then transferred onto a transfer sheet under application of a transfer field and the transfer sheet is subsequently separated from the drum; characterized by the provision of a transfer sheet separating/conveying member formed of an electrically conductive material and having a conductive surface in contact with said transfer sheet and disposed downstream of a transfer station where the transfer step takes place, as viewed in the direction of the drum, support means associated with the separating/conveying member for positioning part thereof close to or in contact with the drum surface, drive means for causing a movement of the separating/conveying member in a direction such that it moves in the same direction as the drum surface where it is opposed to the latter, and a power supply means for applying a voltage of the same polarity as that of the transfer sheet to the separating/conveying member.

2. An apparatus according to claim 1 in which the transfer sheet separating/conveying member comprises a pair of endless belts which are spaced apart crosswise of the drum, the distance between the outer extremities of the pair of endless belts being substantially equal to or slightly less than the width of the drum.

3. An apparatus according to claim 2 in which the outer end regions of the endless belts are convered with an electrically insulating layer.

4. An apparatus according to claim 2 in which an outer edge of the endless belt which is located opposite to the drum is shaped into a rounded form and a region of the belt surface which is located inward of the rounded edge is covered with an electrically insulating layer.

5. An apparatus according to claim 1 in which the transfer sheet separating/conveying member comprises a single endless belt with opposite outer end and having a width which is substantially equal to or slightly less than the width of the drum.

6. An apparatus according to claim 5 in which the outer end of the endless belt is covered with an electrically insulating layer.

7. An apparatus according to claim 5 in which an outer edge of the endless belt which is located opposite to the drum is shaped into a rounded form and a region of the belt surface located inward of the rounded edge is covered with an electrically insulating layer.

8. An apparatus for separating and conveying a transfer sheet for use in an electrophotographic copying machine in which a toner is deposited on an electrostatic latent image which is formed on the surface of a photosensitive drum to provide a toner image which is transferred onto a transfer sheet upon application of a transfer field and the transfer sheet subsequently separated from the drum; characterized by the provision of a transfer sheet separating/conveying member formed of an electrically conductive material and having a conductive surface in contact with said transfer sheet and disposed downstream, as viewed in the direction of rotation of the drum, of a transfer station where the transfer step takes place, support means associated with the separating/conveying member for positioning part thereof close to or in contact with the drum surface, and drive means for causing a movement of the separating/conveying member in a manner such that it moves in the same direction as the drum surface in a region where it is located opposite to the drum, and means to connect the separating/conveying member to the ground through a constant voltage element.

9. An apparatus according to claim 8 in which the transfer sheet separating/conveying member comprises a pair of endless belts spaced apart crosswise of the drum, the distance between the outer extremities of the pair of endless belts being substantially equal to or slightly less than the width of the drum.

10. An apparatus according to claim 9 in which a lateral end of the endless belt is covered with an electrically insulating layer.

11. An apparatus according to claim 9 in which a lateral edge of the endless belt which is located opposite to the drum is shaped into a rounded form, a region of the belt surface located inward of the rounded edge being covered with an electrically insulating layer.

12. An apparatus according to claim 8 in which the transfer sheet separating/conveying member comprises a single endless belt with opposite outer ends and having a width which is substantially equal to or slightly less than the width of the drum.

13. An apparatus according to claim 12 in which the outer end of the endless belt is covered with an electrically insulating layer.

14. An apparatus according to claim 12 in which an outer edge of the endless belt which is located opposite to the drum is shaped into a rounded form, a region of the belt surface located inward of the rounded edge being covered with an electrically insulating layer.

15. An apparatus for separating and conveying a transfer sheet for use in an electrophotographic copying machine in which a toner is deposited on an electrostatic latent image which is formed on the surface of a photosensitive drum to provide a toner image which is then transferred onto a transfer sheet under application of a transfer field and the transfer sheet is subsequently separated from the drum; characterized by the provision of a transfer sheet separating/conveying member formed of an electrically conductive material and having a conductive surface in contact with said transfer sheet and disposed downstream, as viewed in the direction of rotation of the drum, of a transfer station where the transfer step takes place, support means associated with the separating/conveying member for positioning part thereof close to or in contact with the drum surface, and drive means for causing a movement of the separating/conveying member in a manner such that it moves in the same direction as the drum surface in a region where it is located opposite to the drum, and means to connect the separating/conveying member to the ground through a resistor.

16. An apparatus according to claim 15 in which the transfer sheet separating/conveying member comprises a pair of endless belts spaced apart crosswise of the drum, the distance between the outer extremities of the pair of endless belts being substantially equal to or slightly less than the width of the drum.

17. An apparatus according to claim 16 in which a lateral end of the endless belt is covered with an electrically insulating layer.

18. An apparatus according to claim 16 in which a lateral edge of the endless belt which is located opposite to the drum is shaped into a rounded form, a region of the belt surface located inward of the rounded edge being covered with an electrically insulating layer.

19. An apparatus according to claim 15 in which the transfer sheet separating/conveying member comprises a single endless belt of a width which is substantially equal to or slightly less than the width of the drum.

20. An apparatus according to claim 19 in which an outer end of the endless belt is covered with an electrically insulating layer.

21. An apparatus according to claim 19 in which a lateral edge of the endless belt which is located opposite to the drum is shaped into a rounded form, a region of the belt surface located inward of the rounded edge being covered with an electrically insulating layer.

* * * * *